US005293880A

United States Patent [19]

Levitt

[11] Patent Number: 5,293,880

[45] Date of Patent: Mar. 15, 1994

[54] ATHLETIC MOUTHGUARD

[76] Inventor: Steven J. Levitt, 50 Brainard Rd., Ste. 213, Allston, Mass. 02134

[21] Appl. No.: 770,190

[22] Filed: Oct. 2, 1991

[51] Int. Cl.[5] ..... A61C 5/14

[52] U.S. Cl. ..... 128/861; 128/862

[58] Field of Search ..... 128/859-862, 128/62; 2/2; 272/95

[56] References Cited

U.S. PATENT DOCUMENTS

| | | | |
|---|---|---|---|
| Re. 33,442 | 11/1990 | George | 128/860 |
| D. 215,685 | 10/1969 | Helmer . | |
| 1,843,377 | 2/1932 | Record | 128/861 |
| 2,192,558 | 3/1940 | Poindexter . | |
| 2,833,278 | 5/1958 | Ross | 128/862 |
| 3,103,217 | 9/1963 | Bulter | 128/862 |
| 3,236,235 | 2/1966 | Jacobs | 128/862 |
| 3,250,272 | 5/1966 | Greenberg . | |
| 3,319,626 | 5/1967 | Lindsay | 128/861 |
| 3,334,417 | 8/1967 | Spengeran | 128/862 |
| 3,407,809 | 10/1968 | Ross . | |
| 3,411,501 | 11/1968 | Greenberg . | |
| 3,496,936 | 2/1970 | Gores | 128/861 |
| 3,682,164 | 8/1972 | Miller | 128/861 |
| 3,768,465 | 10/1973 | Helmer . | |
| 4,185,817 | 1/1980 | Peterson | 128/861 |
| 4,791,941 | 12/1988 | Schaefer | 128/861 |
| 4,848,365 | 7/1989 | Guarlotti et al. . | |
| 4,955,393 | 9/1990 | Adell . | |
| 5,031,638 | 7/1991 | Castaldi | 128/862 |
| 5,082,007 | 1/1992 | Adell | 128/859 |
| 5,152,301 | 10/1992 | Kittelsen | 128/861 |

*Primary Examiner*—Michael A. Brown
*Attorney, Agent, or Firm*—Kriegsman & Kriegsman

[57] ABSTRACT

An athletic mouthguard adapted for use by athletes and other persons engaged in physical activities which might result in occlusal or craniofacial stress. In one embodiment, the athletic mouthguard is a unitary structure which comprises a mouthpiece and an elongated strap adapted for attachment to the face mask of a helmet or the like. The mouthpiece, which is designed for use over the upper set of teeth of the wearer, includes an inner peripheral wall, an outer peripheral wall, and a connecting wall, the inner surfaces of which define a channel. The occlusal surface of the channel is more narrow in the anterior region and becomes more broad as one moves posteriorly so as to accommodate the non-uniform widths of the various teeth. In addition, the occlusal surface of the channel becomes progressively more concavely-shaped as one moves posteriorly from the first bicuspid tooth to accommodate the increasing convexity of the posterior teeth. The buccal surface of the channel is shaped to a pair of retention bars, which serve to retain the mouthpiece against the upper set of teeth. The inner peripheral wall and the outer peripheral wall of the mouthpiece curve and taper in the vestibule and palatal areas to conform to the shape of the upper jaw. The connecting wall is thicker in the posterior regions than in the anterior regions so that an upwardly directed blow is delivered more to the posterior teeth than to the anterior teeth.

6 Claims, 12 Drawing Sheets

ATHLETIC MOUTHGUARD

BACKGROUND OF THE INVENTION

The present invention relates generally to mouthguards intended to be worn by athletes and other persons engaged in physical activities which might result in occlusal or craniofacial stress and more particularly to a new and improved athletic mouthguard.

Typically, athletic mouthguards serve two purposes: First, they reduce the possibility and/or severity of tooth damage by dispersing over a relatively large surface area the impact of a blow delivered to a relatively small surface area. Second, they reduce the possibility and/or severity of cranial injury, e.g. concussions, by cushioning the impact of an upwardly directed blow administered to the upper set of teeth by the lower set of teeth. As can readily be appreciated, either one or both of the above-stated objectives may be adversely affected by the use of an ill-fitting and/or uncomfortable mouthguard.

Many different types of athletic mouthguards are presently in use. One type of mouthguard, which is available generally only from a dentist, is made by having the dentist take an impression of the dental arch and upper teeth of the individual, prepare from the impression a plaster cast corresponding to the dental arch and upper teeth, and then mold a mouthguard from rubber or plastic against the plaster cast. While such mouthguards have generally good comfort, protective and retentive characteristics, they are frequently expensive and time-consuming to fabricate and require the services of skilled dental personnel.

A second type of mouthguard presently in use is a universal mouthguard, which is intended to be worn as received without any form of adaptation to the mouth of the individual user. Such mouthguards are typically made of rubber or plastic and are formed generally to the shape of the upper dental arch and teeth. While these mouthguards are less expensive to fabricate than the first type of mouthguard, they tend to fit loosely and are not retained easily by the user, frequently being dislodged by the same blows they were intended to resist.

A third type of mouthguard presently in use is a universal blank mouthguard, which is typically made of a thermoplastic material capable of being molded and shaped to conform to the dental arch and upper teeth of the individual user. In use, the blank is usually warmed, such as by immersion in hot water, inserted into the mouth of the individual, and then fitted against the dental arch and teeth of the individual. While these in-situ custom-fitted mouthguards are also typically less expensive than the first type of mouthguard, they are also typically not nearly as retentive or comfortable as such mouthguards.

The following patents, all of which are incorporated by reference, may be of interest to the present invention. U.S. Pat. No. 4,955,393, which issued on Sep. 11, 1990 to Adell, relates to a mouthguard that has a body having upper and lower troughs conforming generally to the upper and lower arches. Liners of impression material are disposed in the respective troughs for conformance to the actual impressions of the teeth of the arches. The body has an occlusal wall that contains a series of spaced-apart air/saliva ducts extending in a lingual/buccal fluid communication. The liners are mechanically interlocked to the mouthguard body by interlocking material that extends along the edges of the respective troughs and also by integral connections which extend through the occlusal wall between the two troughs in bridging portions of the occlusal wall that separate the air/saliva ducts.

U.S. Pat. No. 4,848,365, which issued on Jul. 18, 1989 to Guarlotti et al., relates to an improved protective mouthguard blank, which is adapted for in situ custom-fitting by an athlete/patient, and to a method for in situ custom-fitting said mouthguard blank. The protective mouthguard blank has a generally V-shaped channel corresponding to a normal dental arch and is formed from thermoplastic substances which have a softening, moldable temperature in the range of 120–160 degrees F. The protective mouthguard blank has outer side walls which are longer than the labial vestibule and the buccal vestibules of the athlete/patient. The resulting in situ custom-formed protective mouthguard consequently has an outer side wall which substantially entirely fills the athlete/patient's buccal vestibules and labial vestibule.

U.S. Pat. No. 4,791,941, which issued on Dec. 20, 1988 to Schaefer, relates to an athletic mouthguard useful in contact sports for protecting an athlete's teeth. The mouthguard comprises a U-shaped double trough mouthpiece secured to a connecting strap adapted to be attached to the faceguard on a helmet. The distal end of the connecting strap contains an oblong opening whereby a looped connection can be made with a bar on the face guard by passing the mouthpiece through the oblong opening and pulling the loop into tight engagement with the bar on the faceguard.

U.S. Pat. No. 3,768,465, which issued on Oct. 30, 1973 to Helmer, relates to an apparatus for protecting the mouth area of athletes engaged in contact sports. The apparatus includes a thermo-plastic base member that is heated to receive a bite from the user whereby his dental impressions are applied to such base member. The base member is formed with breathing orifices. Plugs are removably disposed within the breathing orifices to prevent collapse of such orifices while the bite takes place.

U.S. Pat. No. 3,411,501, which issued on Nov. 19, 1968 to Greenberg, relates to a saddle for use in making a mouthpiece comprised of a substantially U-shaped member of channel cross-section including an outer flange, a lingual flange and a web joining them and made of a plastic such that at a pre-determined temperature range below that of boiling water the saddle will retain its essential shape but will be soft enough to take teeth impressions and to retain the teeth impressions below the softening range; a method by which the saddle is used to take teeth impressions in the mouth so that impressions of one set of teeth will be formed on the inside thereof and the impressions of the bite surface of the opposite set of teeth will be formed in the outside surface of the web to thus form a mouthguard which protects both sets of teeth; and the provision of means whereby a strap for attachment to a face or chin guard is removably attached to the mouthguard so that a strong pull thereon will separate the strap from the mouthguard and allow the latter to remain in place over the teeth for continued protection.

U.S. Pat. No. 3,407,809, which issued on Oct. 29, 1968 to Ross, relates to a protective mouthpiece comprising a deformable trough adapted for engagement therein of a natural denture and defined by a base and a pair of inner and outer walls extending away from said base, an elongated bendable strap having an inner end portion connected to said outer wall and an outer end portion releasably securable in adjusted position longitudinally of said strap, and fastener means slidably adjustable longitudinally of said strap to which said outer end portion is connected, said fastener means being a snap fastener having a male component secured to the outer end portion of said strap and a belt arranged and proportioned for yielding frictional engagement about said strap, said belt having a portion with an eye adapted for projection therethrough of said male component, said portion spaced from said strap to define a pocket for releasable reception of said male component when projected through said eye.

U.S. Pat. No. 3,250,272, which issued on May 10, 1966 to Greenberg, relates to a saddle for use in making a mouthpiece comprising a substantially U-shaped member of channel cross-section made of a thermoplastic resin which is fixed in form and resilient up to the temperature range of 185–230 degrees F. but sufficiently soft to take tooth impressions under pressure below said range down to about 130 degrees F. without losing its essential shape and fix them below said temperature, said resin being selected from the class consisting of vinyl acetate-ethylene copolymer having 20–35% by weight of ethyl acrylate, remainder ethylene, said member having inner and outer flanges joined by a web which tapers in thickness downwardly from said inner to said outer flange, so that impressions of one set of teeth may be made on the inside of said channel and impression of the bite surface of the opposite set of teeth may be made in the outer surface of the web without sacrificing thickness of the web as required for proper protection.

U.S. Pat. No. 2,192,558, which issued on Mar. 5, 1940 to Poindexter, relates to a tooth guard and jaw protector comprising a substantially U-shaped body member adapted to fit in the mouth between the teeth of the upper and the lower jaws and having the end portions thereof of substantially rigid material and of substantially H-shaped form in cross section and thus presenting spaced flanges on the upper and the lower sides adapted to engage against the inner and the outer faces of the upper rear and lower rear teeth thereby interlocking the teeth and restraining relative lateral movement of the jaws, said substantially U-shaped body member being adapted to fit and be held within the mouth with the looped portion presented forwardly and being provided on the outer side of the looped portion with flanges of cushion material adapted to cushion between the lips and the front teeth of the wearer.

SUMMARY OF THE INVENTION

It is an object of the present invention to provide a new and improved athletic mouthguard.

It is another object of the present invention to provide an athletic mouthguard comprising a mouthpiece which approximates the size and shape of a person's upper set of teeth more closely than existing mouthpieces.

It is still another object of the present invention to provide an athletic mouthguard comprising a mouthpiece that is more retentive than existing mouthpieces.

It is a further object of the present invention to provide an athletic mouthguard comprising a mouthpiece which provides increased cushioning and impact dispersion to upwardly-directed blows delivered to the upper set of teeth by the lower set of teeth.

It is still a further object of the present invention to provide an athletic mouthguard comprising a mouthpiece that is designed so that the posterior teeth absorb the brunt of an upwardly-directed blow.

Various additional objects, as well as certain features and advantages, of the present invention will be set forth in part in the description which follows, and in part will be obvious from the description or may be learned by practice of the invention. The objects, features and advantages of the invention may be realized and attained by means of the instrumentalities and combinations particularly pointed out in the appended claims.

In accordance with the purpose of the present invention as set forth broadly above, an athletic mouthguard constructed according to one embodiment comprises a mouthpiece having an inner peripheral wall, an outer peripheral wall and a connecting wall, the inner surfaces of said inner peripheral wall, said outer peripheral wall and said connecting wall together defining a channel, said channel being sized and shaped to surround the upper set of teeth of a wearer, said connecting wall having at least one opening extending upwardly from the bottom surface thereof so as to improve the compressibility and absorptive capacity of said connecting wall.

Also according to the purposes of the invention as broadly set forth above, an athletic mouthguard is provided in a second embodiment which comprises a top piece shaped to define an inner peripheral wall, an outer peripheral wall, and a connecting wall, the inner surfaces of said inner peripheral wall, said outer peripheral wall and said connecting wall together defining a channel, said channel being sized and shaped to surround the upper set of teeth of a wearer, a bottom piece connected to the bottom surface of said top piece, and an impact absorbent pad disposed between said top piece and said bottom piece.

The present invention is also directed to an athletic mouthguard comprising a top piece made of a flexible material and a bottom piece, said top piece and said bottom piece being joined together to define a mouthpiece having a pair of side walls, a top wall, a bottom wall, and an inflatable chamber formed therebetween, said top wall being sized and shaped to surround the upper set of teeth of a wearer, and an elongated strap extending outwardly from said mouthpiece, said elongated strap having means for inflating said inflatable chamber so that said top wall expands to conform more closely to the size and shape of the upper set of teeth of the wearer, and means for deflating said inflatable chamber.

BRIEF DESCRIPTION OF THE DRAWINGS

The accompanying drawings, which are hereby incorporated into and constitute a part of this specification, illustrate the preferred embodiments of the invention and, together with the description, serve to explain the principles of the invention. In these drawings wherein like reference numerals represent like parts.

DETAILED DESCRIPTION OF PREFERRED EMBODIMENTS

Figure 1:
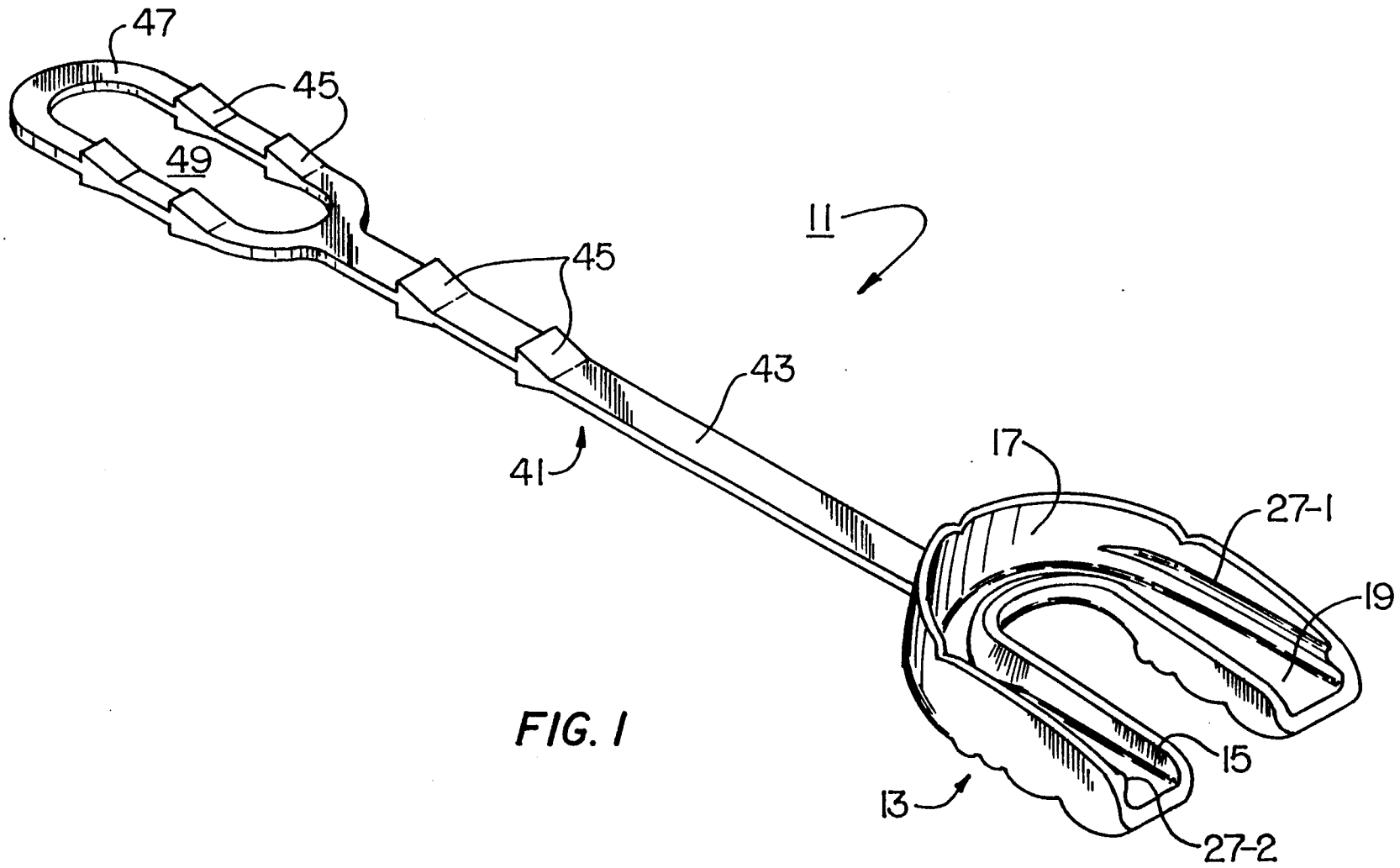
FIG. 1 is a perspective view taken from the top of one embodiment of an athletic mouthguard constructed according to the teachings of the present invention.
Figure 2:
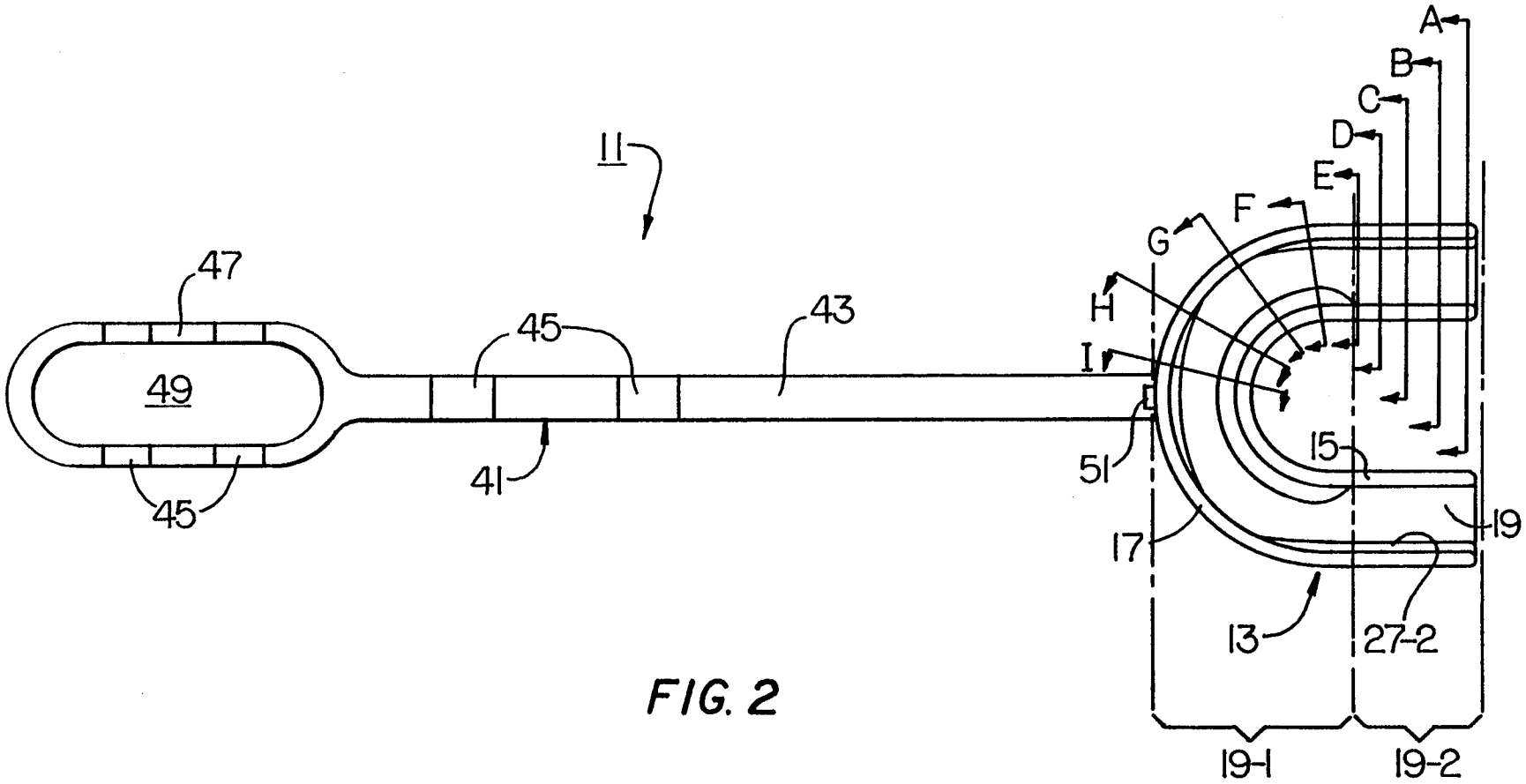
FIG. 2 is a top plan view of the athletic mouthguard shown in FIG. 1.
Figure 3A:
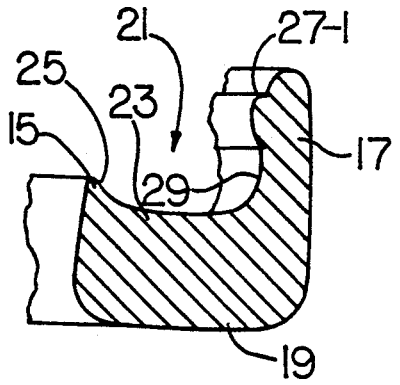
FIGS. 3(*a*) through 3(*i*) are enlarged fragmentary section views of the mouthpiece of FIG. 2 taken along lines A—A through I—I, respectively.
Figure 3B:
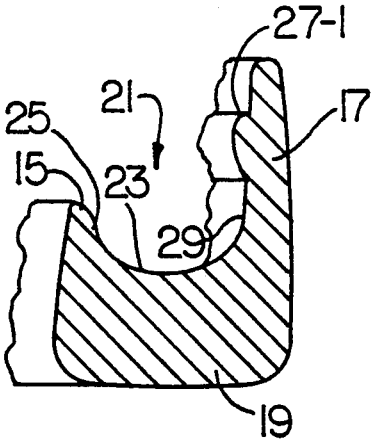
Figure 3C:
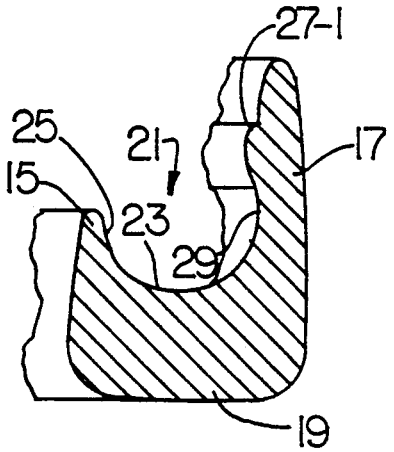
Figure 3D:
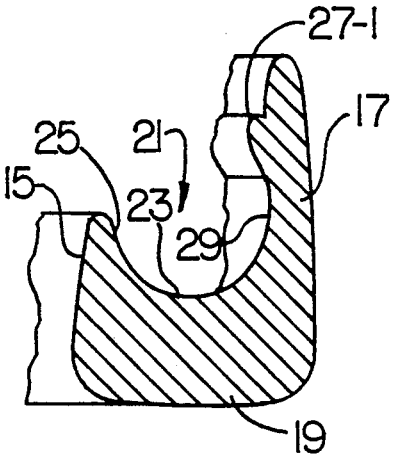
Figure 3E:
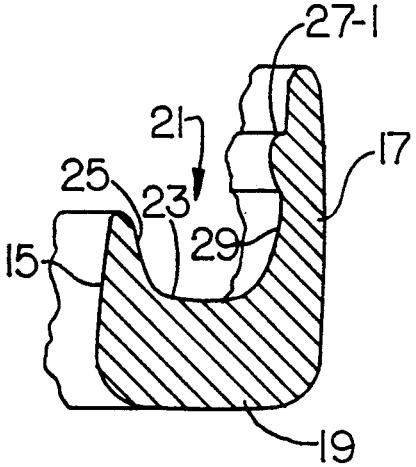
Figure 3F:
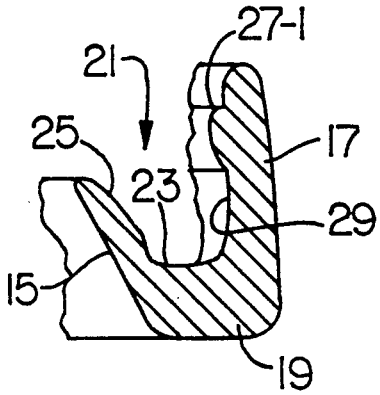
Figure 3G:
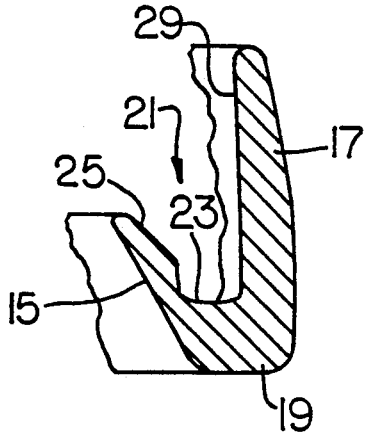
Figure 3H:
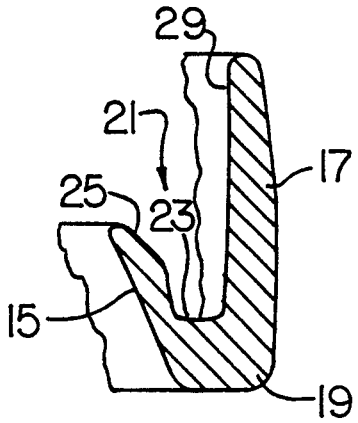
Figure 3I:
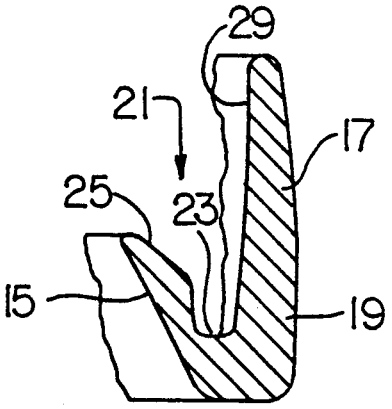

Referring now to the drawings and more particularly to FIGS. 1-3, there is shown one embodiment of an athletic mouthguard constructed according to the teachings of the present invention, the athletic mouthguard being represented generally by reference numeral 11.

Mouthguard 11, which is preferably a unitary structure molded from a compressible, thermoplastic material of the type customarily employed in the manufacture of universal blank mouthguards (such as BF Goodrich brand PVC 55 durometer plastic), comprises a mouthpiece 13.

Mouthpiece 13 includes an inner peripheral wall 15, an outer peripheral wall 17 and a connecting wall 19, the respective inner surfaces of which define a channel 21.

As will be seen from the description below, channel 21 is designed to more closely resemble the size and shape of the upper teeth than do existing mouthpieces, thereby resulting in increased comfort and retention to the wearer.

For example, as can be seen in FIGS. 3(*a*)-3(*i*), the occlusal surface 23 of channel 21 has a non-uniform width, being about 1-1.5 mm wide in the incisor region (see e.g. FIG. 3(*i*)), about 3 mm wide in the canine region (see e.g. FIG. 3(*g*)), about 4 mm wide in the bicuspid region (see e.g. FIG. 3(*f*)), and about 4.5-5 mm wide in the molar region (see e.g. FIG. 3(*a*)).

In addition, the occlusal surface 23 of channel 21 becomes increasingly more concave as one moves posteriorly from the canine and incisor regions (see FIGS. 3(*g*)-3(*i*)), which are relatively flat, to the bicuspid and molar regions (see FIGS. 3(*f*)-3(*a*)). This curvature, which complements the convexity of the posterior teeth, starts just below the middle one-third to the incisal one-third of the posterior teeth.

As can further be seen in FIGS. 3(*a*)-3(*i*), the lingual surface 25 of channel 21 is shaped to conform to the varying lingual surfaces of the upper teeth. For example, in the molar region (see FIGS. 3(*a*)-3(*e*)), the lingual surface 25 slopes upwardly from the occlusal surface 23 in a fairly uniform manner. By contrast, in the bicuspid, canine and incisor regions (see FIGS. 3(*f*)-3(*i*)), the lingual surface 25 first extends vertically upwardly from the occlusal surface 23 for a distance of about 2 mm and then curves outwardly.

To make mouthpiece 13 more comfortable to the wearer, both inner wall 15 and outer wall 17 upwardly taper in width. In addition, inner wall 15 is angled in the bicuspid, canine and incisor regions (see FIGS. 3(*f*)-3(*i*) to correspond to the shape of the palate.

To increase the retentiveness of mouthpiece 13, a pair of retention bars 27-1 and 27-2, each having a width of approximately 1 mm, are formed on the buccal surface 29 of channel 21. Each bar 27 extends anteriorly from the posterior aspect of mouthpiece 13 to a point corresponding to approximately the mesial of the first bicuspid at a depth sufficient to permit its engagement with the posterior teeth of the wearer between the gingival third and the middle third, i.e., to coincide with the convex aspect of the posterior teeth located approximately 5 mm away from the cusp tip. As can be seen best in FIGS. 3(*a*)-3(*f*), the top and bottom halves of each bar 27 are not symmetrical; rather, the top half of each bar 27 curves more sharply than does the bottom half.

Figure 4:
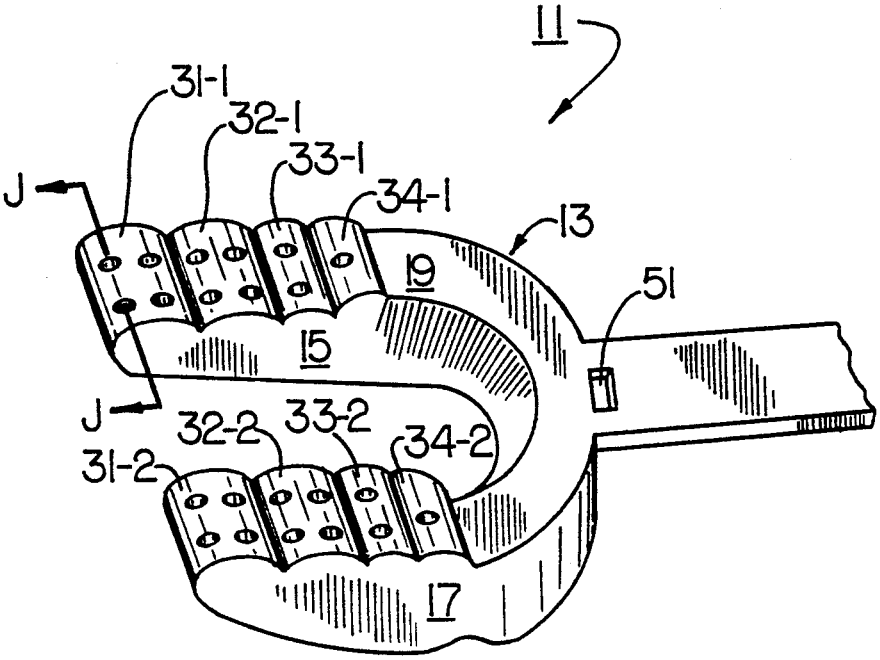
FIG. 4 is a fragmentary perspective view taken from the bottom of the athletic mouthguard shown in FIG. 1.
Figure 5:
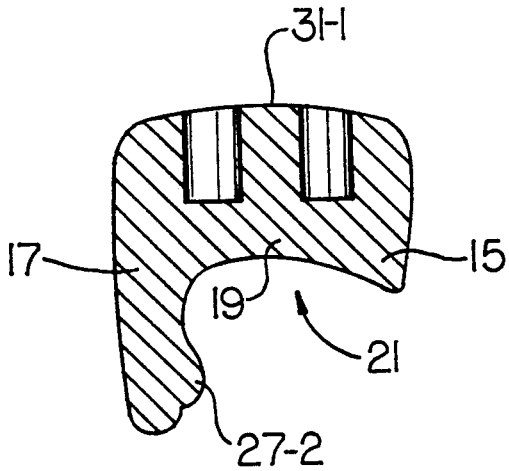
FIG. 5 is an enlarged section view of the mouthpiece of FIG. 4 taken along line J—J.

Referring now to FIGS. 4 and 5, it can be seen that connecting wall 19 is designed for improved absorption of upwardly-directed blows administered to the upper set of teeth by the lower set of teeth. In particular, it should be noted that the posterior portion 19-1 of wall 19 is slightly thicker, e.g. about 0.5 mm, than the anterior portion 19-2 of wall 19 so that the brunt of an upwardly-directed blow is directed to the molar and first bicuspid teeth, which are wider than the incisors and canine teeth and more capable of withstanding a blow. To further assist in impact absorption and dispersion, the aforementioned thicker posterior portions of connecting wall 19 are shaped to define a plurality of convex-shaped downwardly-extending sections 31-1 and 31-2 through 34-1 and 34-2. Preferably, sections 31 and 32 are about 10 mm in length and sections 33 and 34 are about 5 mm in length. A plurality of holes 35, which extend upwardly from the bottom surface of wall 19 to a distance of about 3 mm from channel 21, are formed in sections 31 through 34. Holes 35 improve the compressibility of sections 31 through 34, thereby making them more impact-absorptive. Preferably, 4 holes are formed in each of sections 31-1, 31-2, 32-1, and 32-2, 2 holes are formed in each of sections 33-1 and 33-2, and 1 hole is formed in each of sections 34-1 and 34-2.

As can readily be appreciated, one or more of the aforementioned structural features of connecting wall 19 could be applied to the anterior regions of the mouth piece instead of, or in addition to, the posterior regions of the mouthpiece as described above.

Referring back now to FIGS. 1 and 2, athletic mouthguard 11 also includes an elongated strap 41 which is adapted to be attached to a helmet having a face guard containing a cross bar or to other similar athletic equipment. Strap 41 includes an elongated stem 43 which terminates at one end in an open loop 47 containing an oblong shaped internal opening 49. Oblong opening 49 is preferably aligned in the elongated direction of strap 41 and provides an expendient means for attachment or detachment of strap 41 to a helmet cross bar or the like by looping stem 43 around the cross bar and passing mouthpiece 13 through opening 49 and pulling the open loop end 47 in tight engagement with the cross bar. To prevent loop end 47 from sliding relative to stem 43 and/or to provide some measure of adjustability with respect to amount of stem 43 pulled through opening 49, a plurality of generally right triangularly-shaped stops 45 are formed on both sides of stem 43.

As can be seen in FIG. 2, stem 43 is shaped to define a hole 51 at its point of contact with mouthpiece 13. The provision of hole 51 is intended merely to reduce the amount of material that must be cut away from and, if necessary, filed down from mouthpiece 13 if the wearer wishes to use mouthpiece 13 without strap 41.

In use, mouthguard 11 may be used either as a universal mouthguard, in which case it is simply inserted into the mouth of the wearer and worn over the upper set of teeth, or as a universal blank mouthguard, in which case it is heated until malleable and then bitten by the wearer and fitted to his teeth in the conventional manner. If desired, strap 41 may be attached to a helmet or the like or may be permanently removed from mouthpiece 13 as described above.

Figure 6:
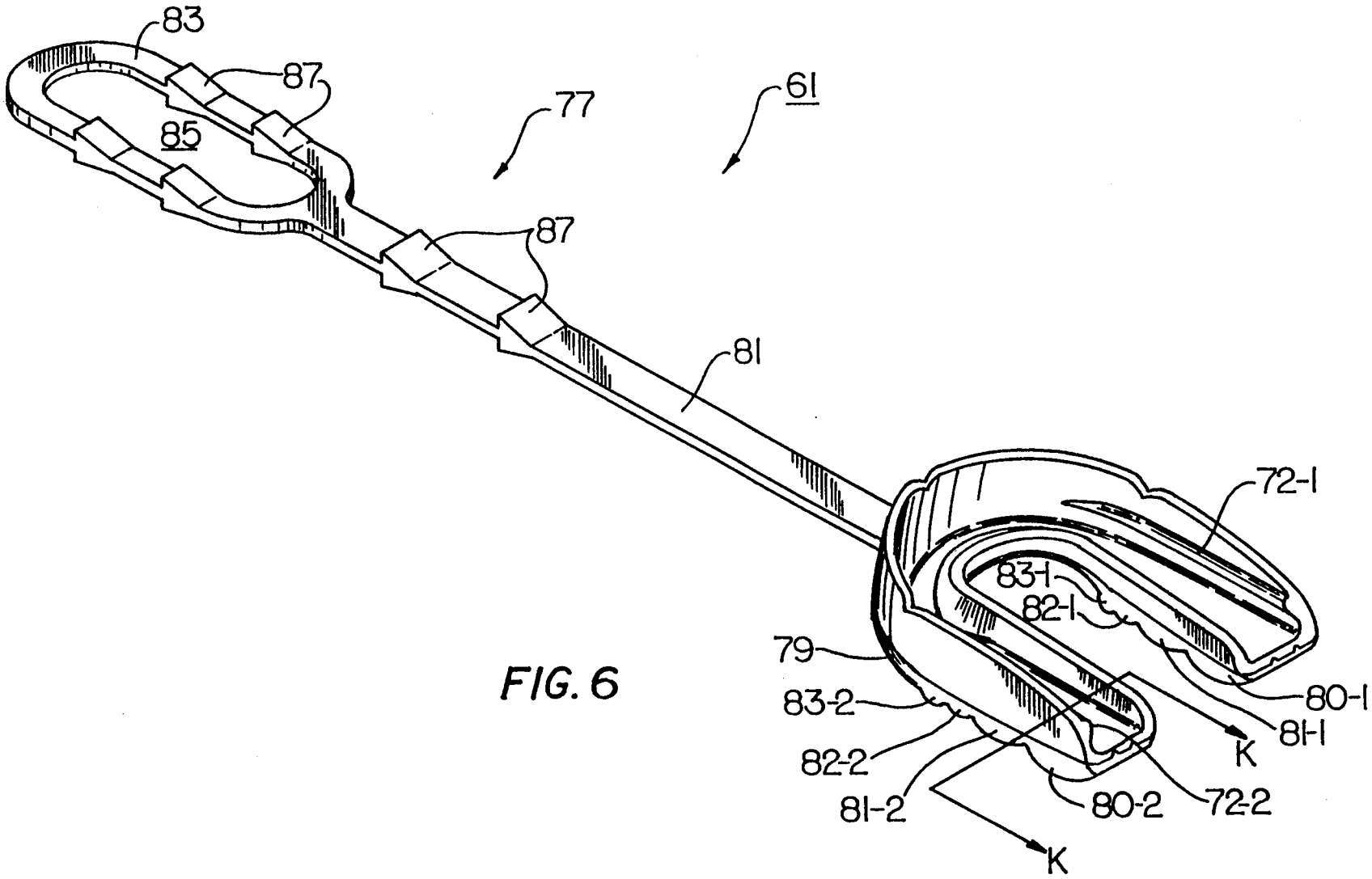
FIG. 6 is a perspective view taken from the top of a second embodiment of an athletic mouthguard constructed according to the teachings of the present invention.
Figure 7:
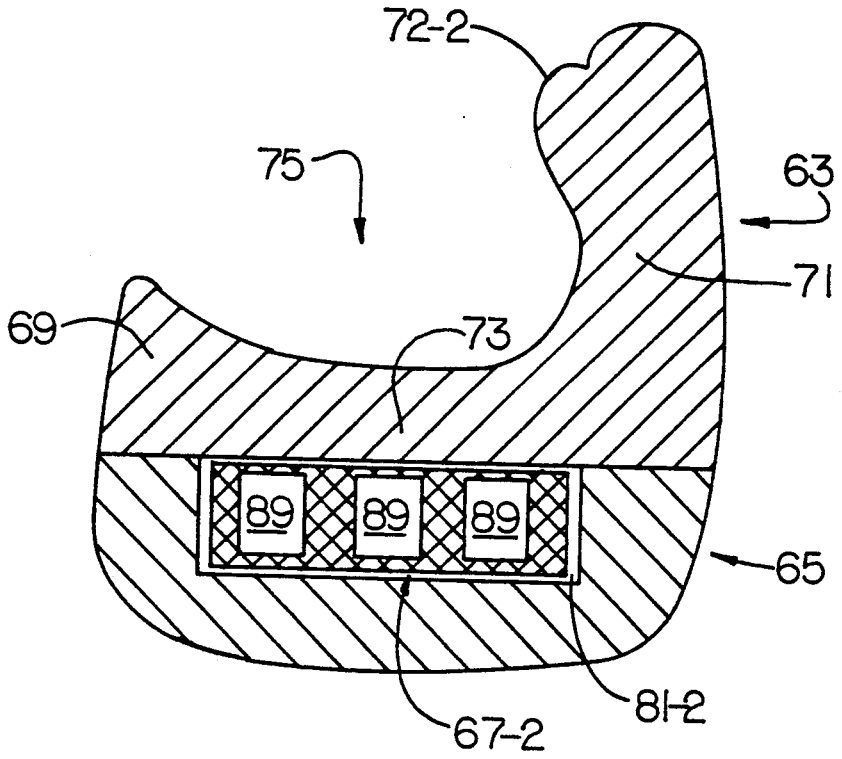
FIG. 7 is an enlarged section view of the athletic mouthguard of FIG. 6 taken along line K—K.
Figure 8:
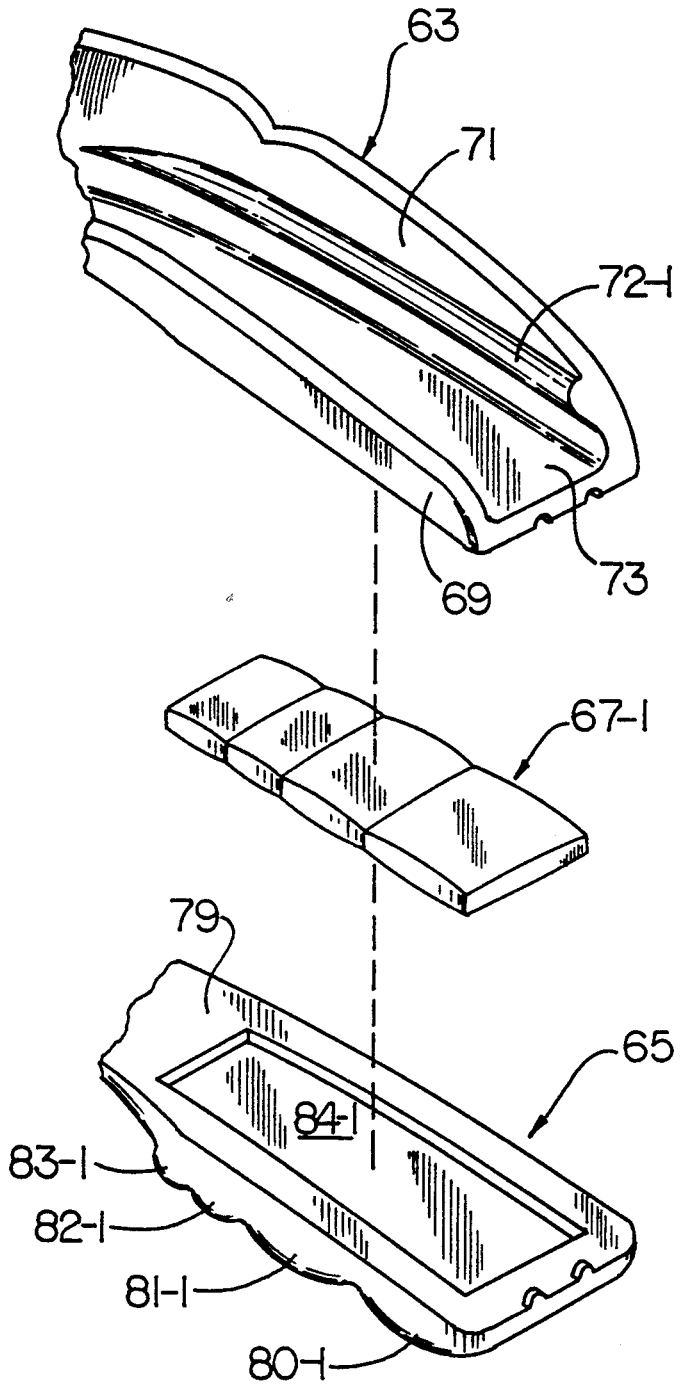
FIG. 8 is an enlarged fragmentary exploded top perspective view of the athletic mouthguard of FIG. 6.

Referring now to FIGS. 6–8, there is illustrated second embodiment of an athletic mouthguard constructed according to the teachings of the present invention, the athletic mouthguard being represented generally by reference numeral 61.

Mouthguard 61 comprises a top piece 63, a bottom piece 65 and a pair of impact absorbent pads 67-1 and 67-2. Top piece 63, which is preferably made of a compressible, thermoplastic material conventionally used in the manufacture of universal blank mouthguards, is shaped to define an inner peripheral wall 69, an outer peripheral wall 71 having a pair of retention bars 72-1 and 72-2, and a connecting wall 73 of uniform thickness. Walls 69 and 71 are sized and shaped to curve and taper in the same fashion as walls 15 and 17, respectively, of mouthguard 11. The inner surfaces of walls 69, 71 and 73 together define a channel 75. Channel 75 is identical in shape and size to channel 21 of mouthguard 11.

Bottom piece 65, which is preferably made of the same material as top piece 63, is sized and shaped to define an elongated strap 77 and an arcuately-shaped wall 79. Strap 77 is identical in size and shape to strap 41 of mouthguard 11 and includes an elongated stem 81 which terminates at one end in an open loop 83 containing an oblong shaped internal opening 85 and has a plurality of generally right triangularly-shaped stops 87 extending outwardly therefrom on both sides. Wall 79, which is mounted on the bottom of connecting wall 73 with a suitable adhesive (not shown) or which is melted thereonto by heating, has a bottom surface virtually identical to that of wall 19 of mouthguard 11 (including a plurality of downwardly-extending convex-shaped sections 80-1 and 80-2 through 83-1 and 83-2). Unlike wall 19 of mouthguard 11, however, wall 79 does not have any holes formed thereonto. A pair of generally rectangularly-shaped cavities 84-1 and 84-2, which are adapted to receive pads 67-1 and 67-2, respectively, are formed in wall 79.

Impact absorbent pads 67-1 and 67-2, which may be, for example, a block of material, such as a plastic, which is shaped to define a plurality of pockets 89, in which pressurized air or a suitable liquid or gel is maintained, serve as additional cushioning material to absorb the impact of an upwardly-directed blow. Preferably, each pad 67 is divided into four sections corresponding to the dimensions of sections 80 through 83 of wall 79. Preferably, the two most posterior sections of each pad 67 include 6 pockets 89, the next most posterior section of each pad 67 includes 4 pockets 89, and the remaining section of each pad 67 includes 2 pockets 89.

Mouthguard 61 may be used and worn in the same manner as mouthguard 11.

Figure 9:
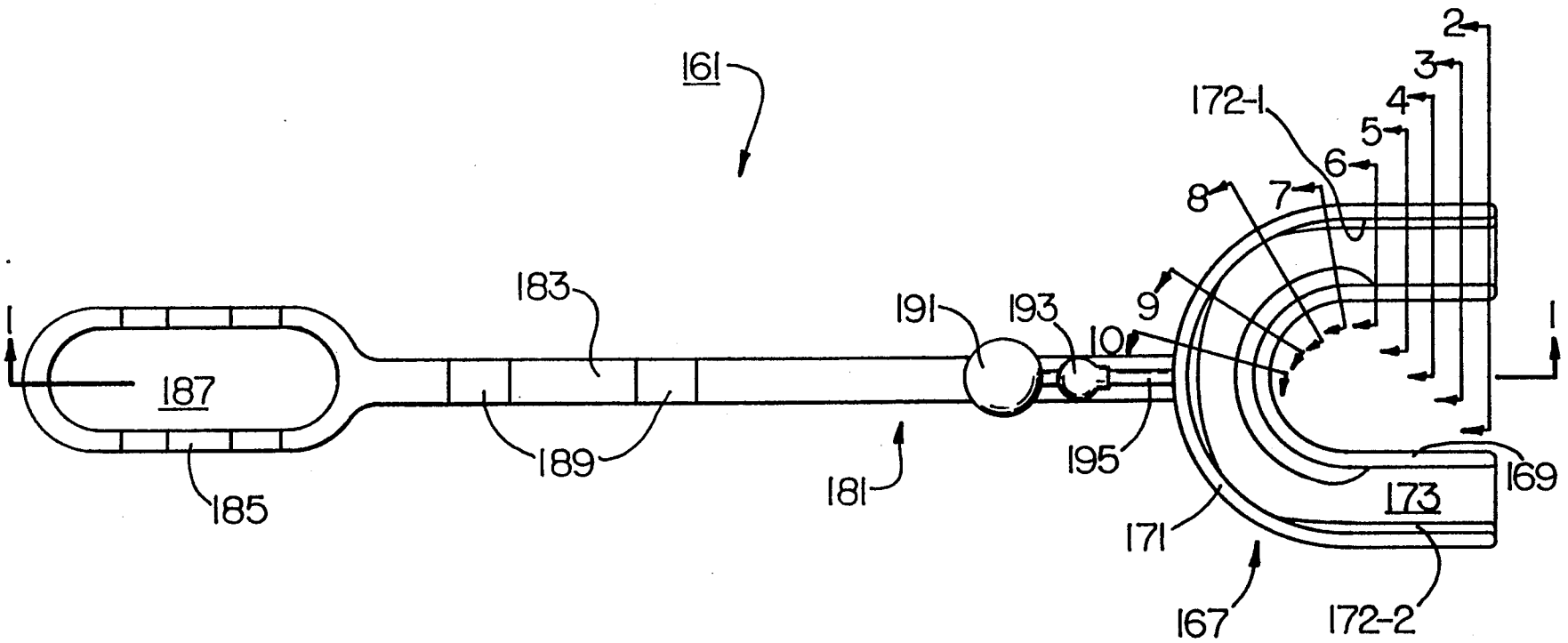
FIG. 9 is a top view of a third embodiment of an athletic mouthguard constructed according to the teachings of the present invention.
Figure 10:
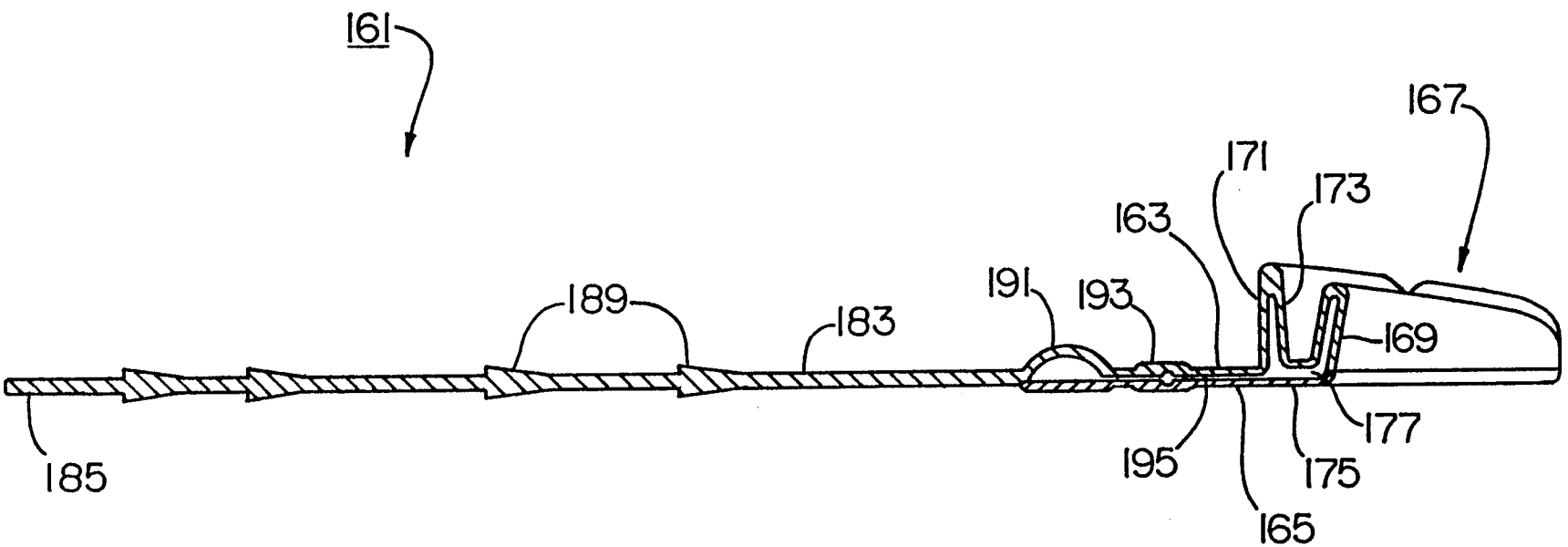
FIG. 10 is a section view of the athletic mouthguard of FIG. 9 taken along line 1—1.
Figure 11A:
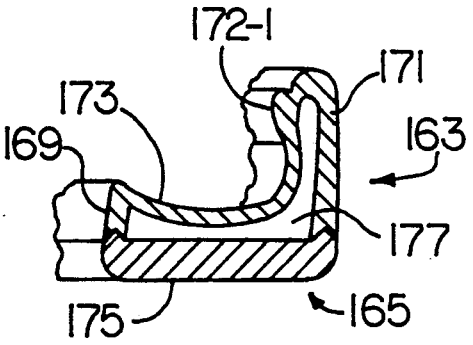
FIGS. 11(*a*) through 11(*i*) are enlarged fragmentary of the athletic mouthguard of FIG. 9 taken along lines 2—2 through 10—10, respectively.
Figure 11B:
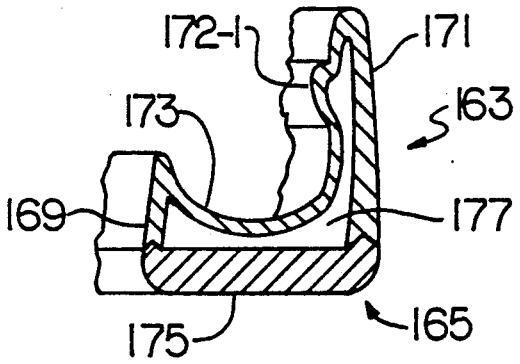
Figure 11C:
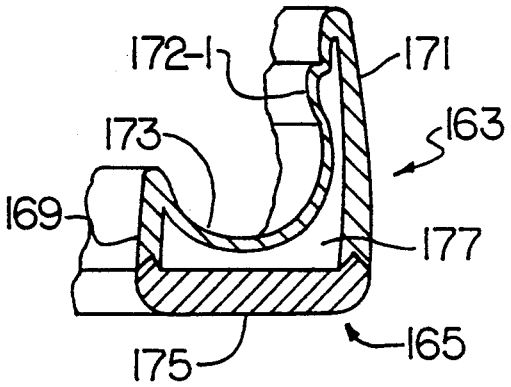
Figure 11D:
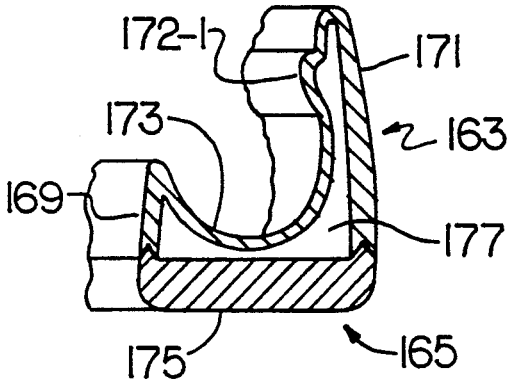
Figure 11E:
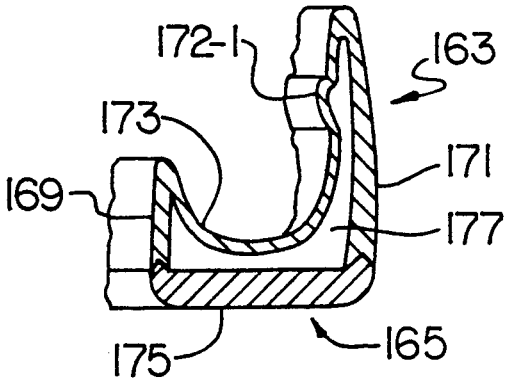
Figure 11F:
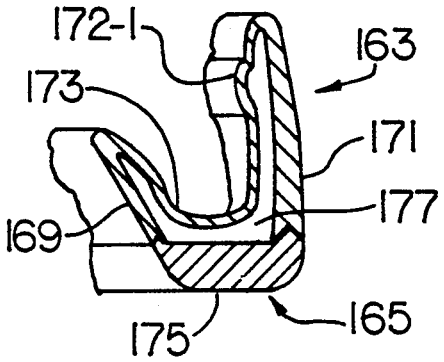
Figure 11G:
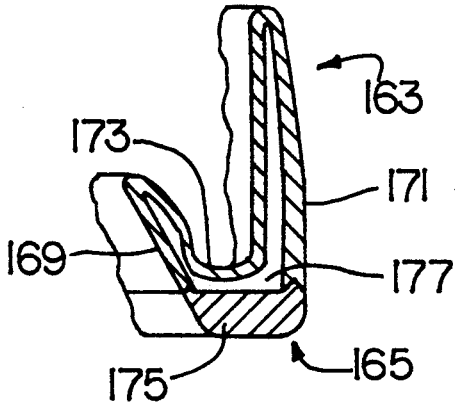
Figure 11H:
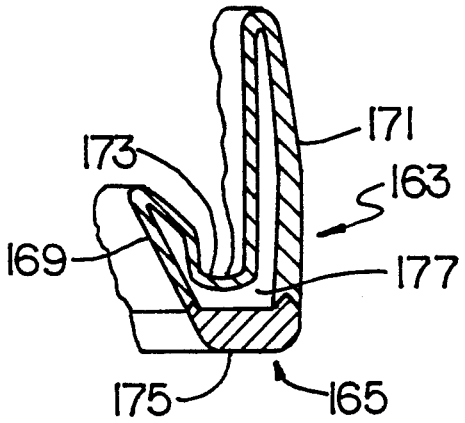
Figure 11I:
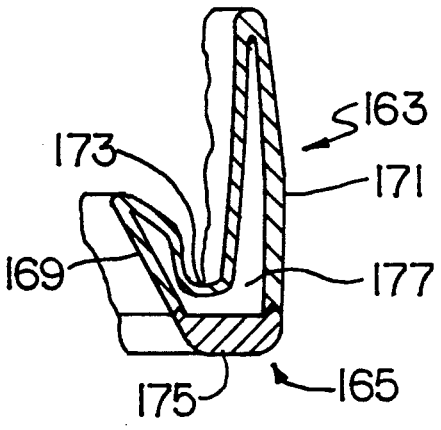

Referring now to FIGS. 9–11, there is illustrated a third embodiment of an athletic mouthguard constructed according to the teachings of the present invention, the athletic mouthguard being represented by reference numeral 161.

Mouthguard 161 comprises a top piece 163, which is made of a flexible material, such as a flexible plastic, and a bottom piece 165, which may or may not be made of a flexible material. Top piece 163 and bottom piece 165, which are preferably joined together through mating bottom and top surfaces, respectively, and an adhesive material (not shown), are shaped to define a mouthpiece 167 having a pair of side walls 169 and 171 (side wall 171 including a pair of retention bars 172-1 and 172-2), a top wall 173, a bottom wall 175, and an inflatable chamber 177 formed therebetween. Preferably, the thickness of top wall 173 is less than that of walls 169, 171 and 175 so that top wall 173 will expand more than the other walls when chamber 177 becomes inflated. The external features of mouthpiece 167 are virtually identical to those of mouthpiece 13, except that mouthpiece 167 has a flat bottom surface of uniform thickness and does not have any holes formed therein.

Top piece 163 and bottom piece 165 also define an elongated strap 181. Strap 181 includes an elongated stem 183 which, like stem 43 of mouthguard 11, terminates at one end in an open loop 185 containing an oblong shaped internal opening 187 and has a plurality of generally right triangularly-shaped stops 189 extending outwardly therefrom on both sides.

Strap 181 also includes a pump 191 for inflating chamber 177 with air and a release valve 193 for releasing air from chamber 177, pump 191 and release valve 193 communicating with chamber 177 through a fluid conduit 195. As can readily be appreciated, as chamber 177 inflates, the walls of mouthpiece 167, particularly top wall 173, expand outwardly. By inflating chamber 177 while mouthpiece 167 is placed over a person's upper teeth, it is possible to have top wall 173 expand until it conforms to the shape of the person's teeth, thereby resulting in a highly comfortable and retentive custom-fit which does not require the boiling and biting of mouthpiece 167. Release valve 193, which is a conventional release valve shown merely for illustrative purposes as a circle, permits deflation of chamber 177, for example, to permit removal of mouthpiece 167 from the person's mouth once it has been inflated.

In another embodiment (not shown), the pump and release valve mechanisms of mouthguard 161 are mounted directly onto the mouthpiece rather than being incorporated into a strap, which may or may not be included in the mouthguard.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. An athletic mouthguard comprising a unitary structure including a mouthpiece and a strap, said mouthpiece having an inner peripheral wall, an outer peripheral wall and a connecting wall, said inner peripheral wall, said outer peripheral wall, and said connecting wall together defining a channel, said channel being sized and shaped to surround the entire upper set of teeth of a wearer, the posterior portion of said connecting wall being thicker than the anterior portion thereof and having an outer surface shaped to define a series of convex sections disposed longitudinally along said posterior portion, each convex section being sized, shaped, and located to mate with a corresponding tooth on the lower jaw of the wearer, each convex section having at least one hole extending partially upward from said outer surface of said connecting wall, the number and positioning of said at least one hole in each said convex sections corresponding to the number and positioning of cusp tips formed on the tooth of the lower jaw adapted for contact therewith so that, when said unitary mouthpiece is worn on the upper set of teeth of a wearer, an upwardly directed blow will be delivered more to the posterior teeth than to the anterior teeth said strap including an elongated stem having a top surface and a bottom surface and terminating in a loop defining an elongated opening, said loop being sized and shaped to permit insertion of said mouthpiece therethrough so that said strap my be looped around and secure to the crossbar of a helmet, said elongated stem having a plurality of raised stops formed on said top and bottom surfaces of said stem, said raised stops being generally right-rectangular in shape and formed on said stem so that their respective hypotenuse face towards each other.

2. The athletic mouthguard as claimed in claim 1 wherein said posterior portion of said connecting wall extends posteriorly from the first bicuspid on each side of the upper set of teeth.

3. The athletic mouthguard as claimed in claim 1 wherein the buccal surface of said channel is shaped to define a pair of retention bars extending posteriorly from points corresponding to the mesial of each of the first bicuspids, said retention bars being adapted to engage the posterior teeth at points between their gingival third and their middle third.

4. The athletic mouthguard as claimed in claim 1 wherein said inner peripheral wall and said outer peripheral wall are upwardly tapering in the palatal and vestibule areas, respectively.

5. The athletic mouthguard as claimed in claim 4 wherein said inner peripheral wall is angled to conform to the shape of the palate.

6. The athletic mouthguard as claimed in claim 1 wherein said unitary mouthpiece is made of a thermoplastic material so that it may be heated and fitted to the mouth of a wearer.

* * * * *